US008677760B2

(12) United States Patent
Khan et al.

(10) Patent No.: US 8,677,760 B2
(45) Date of Patent: Mar. 25, 2014

(54) FUEL NOZZLE WITH INTEGRATED PASSAGES AND METHOD OF OPERATION

(75) Inventors: Abdul Rafey Khan, Greenville, SC (US); Christian Xavier Stevenson, Inman, SC (US); Willy Steve Ziminsky, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1115 days.

(21) Appl. No.: 12/652,858

(22) Filed: Jan. 6, 2010

(65) Prior Publication Data

US 2011/0162371 A1 Jul. 7, 2011

(51) Int. Cl.
*F02C 7/22* (2006.01)
*F02C 1/00* (2006.01)

(52) U.S. Cl.
USPC ..... 60/776; 60/737; 60/742; 60/748

(58) Field of Classification Search
USPC ..... 60/733, 737, 738, 740, 742, 746, 748
See application file for complete search history.

(56) References Cited

U.S. PATENT DOCUMENTS

| | | | | |
|---|---|---|---|---|
| 4,982,570 | A | 1/1991 | Waslo et al. | |
| 5,101,633 | A * | 4/1992 | Keller et al. | 60/737 |
| 5,199,265 | A | 4/1993 | Borkowicz | |
| 5,408,825 | A * | 4/1995 | Foss et al. | 60/39.463 |
| 5,613,363 | A * | 3/1997 | Joshi et al. | 60/737 |
| 6,070,410 | A * | 6/2000 | Dean | 60/737 |
| 6,666,029 | B2 | 12/2003 | Ryan | |
| 6,691,516 | B2 | 2/2004 | Stuttaford et al. | |
| 6,895,759 | B2 | 5/2005 | Knoepfel | |
| 6,897,937 | B2 | 5/2005 | Choi | |
| 7,024,861 | B2 | 4/2006 | Martling | |

* cited by examiner

*Primary Examiner* — Ehud Gartenberg
*Assistant Examiner* — Arun Goyal
(74) *Attorney, Agent, or Firm* — Cantor Colburn LLP

(57) ABSTRACT

Disclosed is a method of operating a secondary fuel nozzle for a turbomachine combustor including delivering a flow of pilot fuel through a pilot fuel channel toward a combustion zone and delivering a flow of air through a plurality of transfer passages arranged around the pilot fuel channel toward the combustion zone. The flow of pilot fuel and the flow of air are combusted in the combustion zone, and a flow of transfer fuel is delivered through the plurality of transfer passages for combustion. A secondary fuel nozzle includes a pilot fuel channel extending along the fuel nozzle to deliver a flow of pilot fuel to a combustion zone. A plurality of transfer passages are arranged around the pilot fuel channel and are configured to deliver a flow of air for combustion with the flow of pilot fuel and to deliver a flow of transfer fuel to the combustion zone.

6 Claims, 5 Drawing Sheets

FUEL NOZZLE WITH INTEGRATED PASSAGES AND METHOD OF OPERATION

BACKGROUND OF THE INVENTION

The subject matter disclosed herein generally relates to turbomachines. More specifically, the subject disclosure relates to fuel and air passages through fuel nozzles for turbomachines.

As requirements for gas turbine emissions have become more stringent, one approach to meeting such requirements is to move from diffusion flame combustors to combustors utilizing lean fuel and air mixtures using a fully premixed operations mode to reduce emissions of, for example, $NO_x$ and CO. These combustors are known in the art as Dry Low $NO_x$ (DLN), Dry Low Emissions (DLE) or Lean Pre Mixed (LPM) combustion systems. These combustors typically include a plurality of primary nozzles which are ignited for low load and mid load operations of the combustor. During fully premixed operations, the primary nozzles supply fuel to feed the secondary flame. The primary nozzles typically surround a secondary nozzle that is utilized for mid load up to fully premixed mode operations of the combustor. Secondary nozzles serve several functions in the combustor including supplying fuel for the fully premixed mode, supplying fuel and air for a pilot flame supporting primary nozzle operation, and providing transfer fuel for utilization during changes between operation modes. In pilot mode, fuel for the operation of the pilot is directed through a pilot fuel passage typically located in the center of the fuel nozzle and air to mix with the pilot fuel is provided via a plurality of pilot air passages surrounding the pilot fuel passage. During transfer operation of the fuel nozzle, additional fuel is urged through the nozzle and into the combustion zone through a group of transfer passages located in the nozzle separate from the pilot fuel passage as a distinct flow of fuel. When the nozzle is not in transfer mode, the current practice is to purge the transfer passages of fuel by flowing transfer air through the transfer passages. In this operation the pilot is surrounded by this flow of lower temperature purge air. Separate passages in the secondary nozzle for pilot fuel, transfer fuel and air, and pilot air result in a complex nozzle assembly. Further, the pilot of the typical nozzle is fuel limited due to the configuration of the pilot fuel and air passages, so that high reactivity fuels cannot be utilized in the pilot.

BRIEF DESCRIPTION OF THE INVENTION

According to one aspect of the invention, a method of operating a secondary fuel nozzle for a turbomachine combustor includes delivering a flow of pilot fuel through a pilot fuel channel toward a combustion zone and delivering a flow of air through a plurality of transfer passages arranged around the pilot fuel channel toward the combustion zone. The flow of pilot fuel and the flow of air are combusted in the combustion zone, and a flow of transfer fuel is delivered through the plurality of transfer passages for combustion in the combustion zone.

According to another aspect of the invention, a secondary fuel nozzle for a turbomachine combustor includes a pilot fuel channel extending axially along the fuel nozzle configured to deliver a flow of pilot fuel to a combustion zone. A plurality of transfer passages are arranged around the pilot fuel channel and are configured to deliver a flow of air for combustion with the flow of pilot fuel in the combustion zone and further configured to deliver a flow of transfer fuel to the combustion zone.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
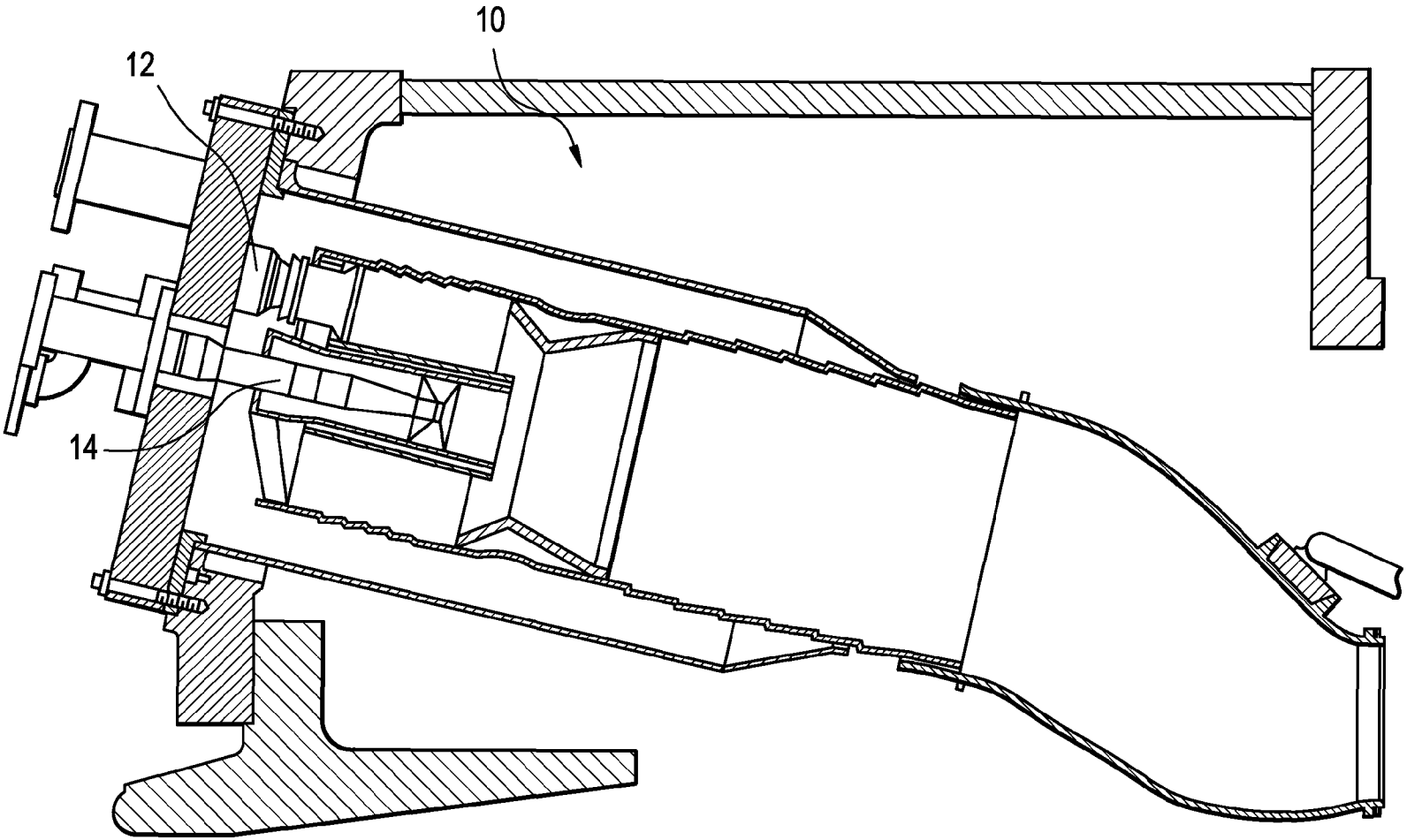
FIG. 1 is a schematic cross-sectional view of an embodiment of a combustor for a turbomachine
Figure 2:
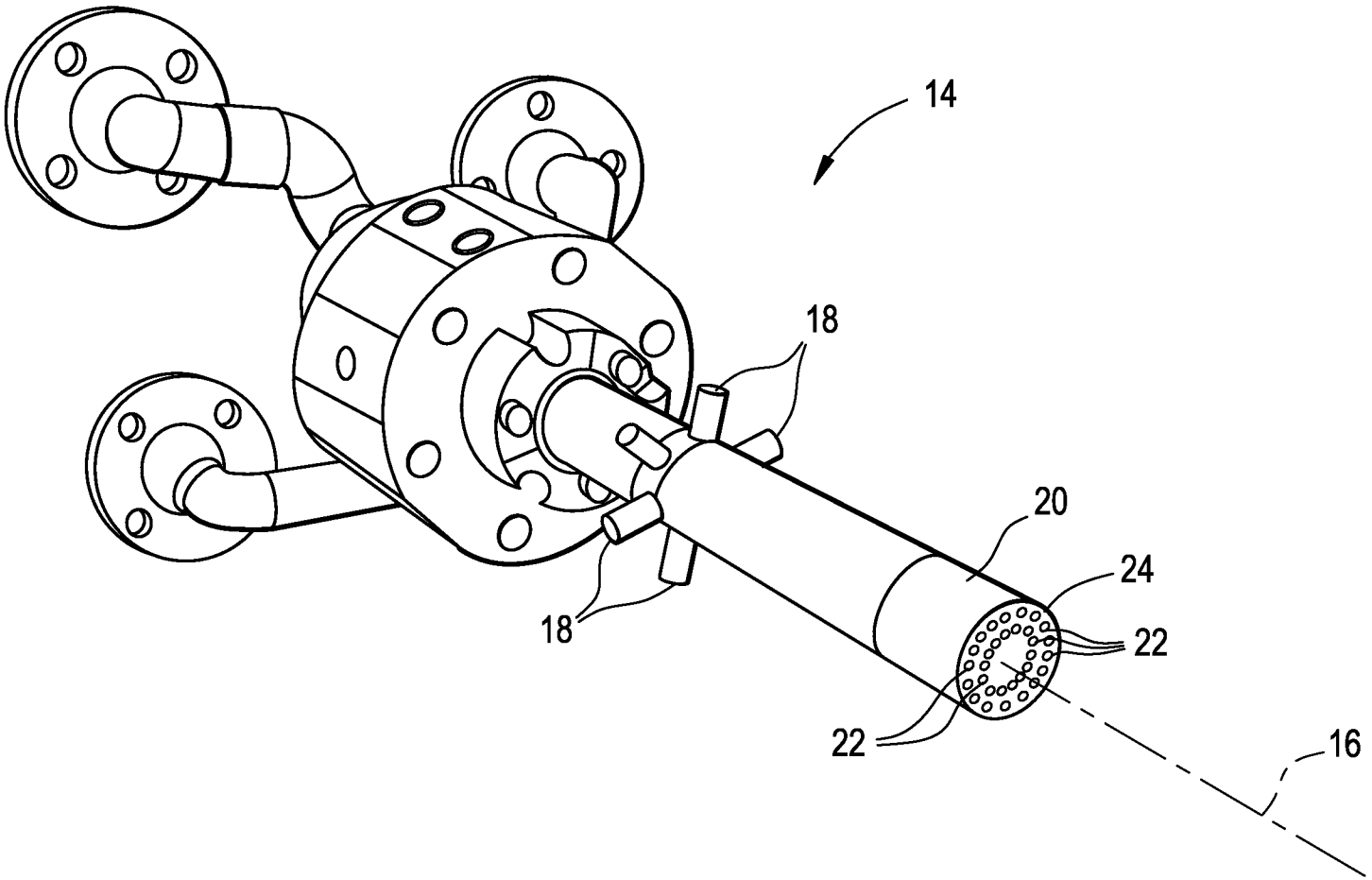
FIG. 2 is a schematic perspective view of an embodiment of a secondary fuel nozzle for the combustor of FIG. 1.

Shown in FIG. 1 is an embodiment of a combustor 10. The combustor includes a plurality of primary nozzles 12 surrounding a secondary nozzle 14. Referring now to FIG. 2, the secondary nozzle 14 is a substantially annular structure having a central axis 16 that includes a plurality of injector holes 18 located upstream of a tip 20 of the secondary fuel nozzle 14. The tip 20 includes a plurality of tip holes 22 at a distal end 24 of the tip 20.

Figure 3:
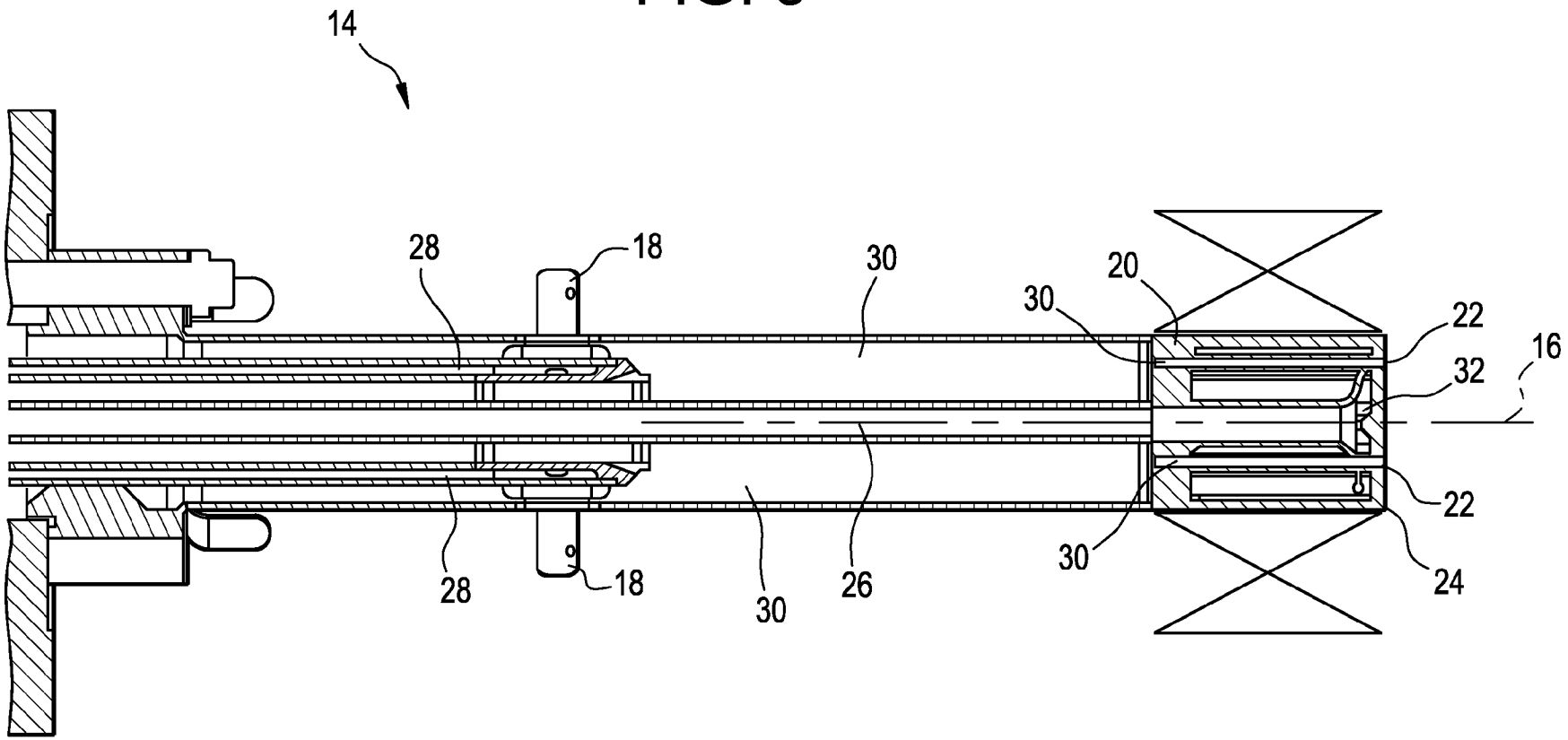
FIG. 3 is a cross-sectional view of an embodiment of a secondary fuel nozzle.

As shown in FIG. 3, the secondary nozzle 14 includes a plurality of fuel passages that are utilized at different times depending on the operation mode of the combustor 10. A pilot fuel passage 26 is disposed at a center of the secondary nozzle 14 along the central axis 16. The pilot fuel passage 26 supplies fuel for, for example, pilot operation of the secondary nozzle 14. During secondary, or full premixed, operation of the combustor 10, fuel is supplied via a plurality of secondary fuel passages 28 to the plurality of injector holes 18. A plurality of transfer passages 30 extend substantially axially along the secondary nozzle 14 and are located radially outboard of the pilot fuel passage 26. The plurality of transfer passages 30 supply transfer fuel for use during transitions between modes.

Figure 4:
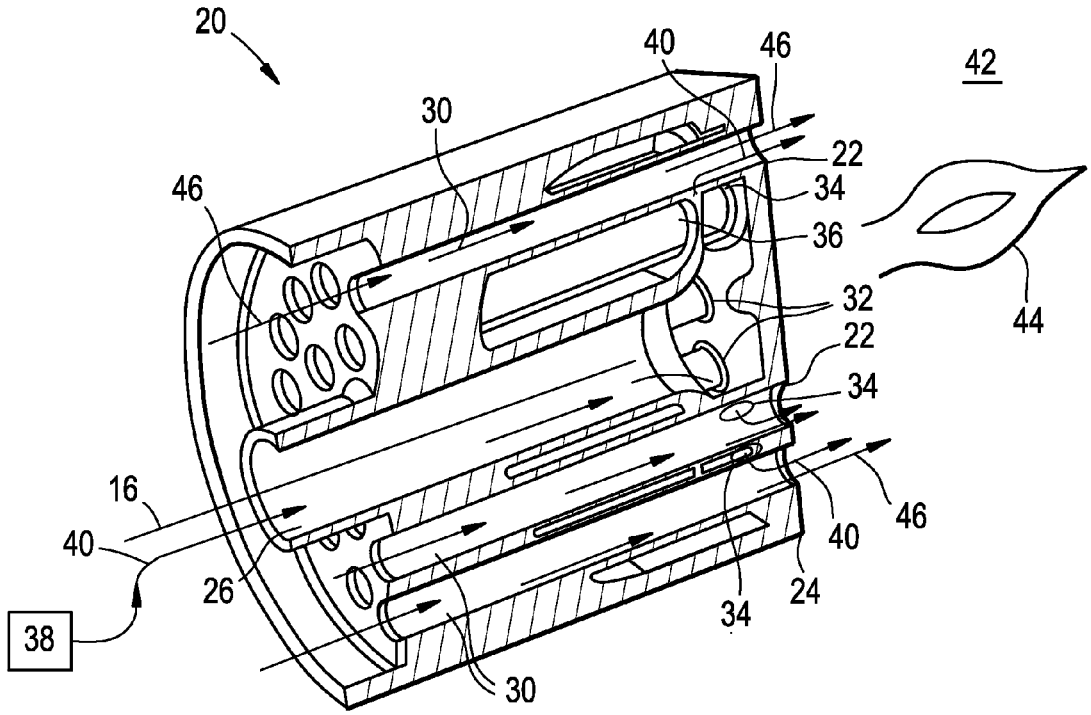
FIG. 4 is a schematic cross-sectional view of an embodiment of a tip of a secondary fuel nozzle.

FIG. 4 illustrates the nozzle tip 20 in more detail. The pilot fuel passage 26 extends through the nozzle tip 20 to a diffuser 32 located at the tip end 24. The plurality of transfer passages 30 extend through the nozzle tip 20, exiting the secondary nozzle 14 at the plurality of tip holes 22. The pilot fuel passage 26 is connected to the plurality of transfer passages 30 via a plurality of pilot holes 34 located in a sidewall 36 of the plurality of transfer passages 30. The pilot fuel passage 26 is connected to a pilot fuel source 38.

When the secondary nozzle 14 is operating as a pilot, for example, in pilot mode, as shown in FIG. 4, a flow of pilot fuel 40 is urged through the pilot fuel passage 26 and proceeds through the diffuser 32. The flow of pilot fuel 40 then proceeds through the plurality of pilot holes 34, through the plurality of transfer passages 30, and into a combustion zone 42 to fuel a pilot flame 44. During pilot mode operation of the fuel nozzle 10, a flow of pilot air 46 is urged through the plurality of transfer passages 30. The flow of pilot air 46 exits the plurality of transfer passages 30 into the combustion zone 42 and is utilized to combust the flow of pilot fuel 40. Further, in some embodiments, the flow of pilot air 46 mixes, at least partially, with the flow of pilot fuel 40 in the plurality of transfer passages 30 prior to combustion in the combustion zone 42. Premixing of the flow of pilot air 46 and the flow of pilot fuel 40 stabilizes the pilot flame 44 and allows for lower operating temperature of the pilot flame 44 thereby reducing $NO_x$ emissions in operation of the combustor 10.

Figure 5:
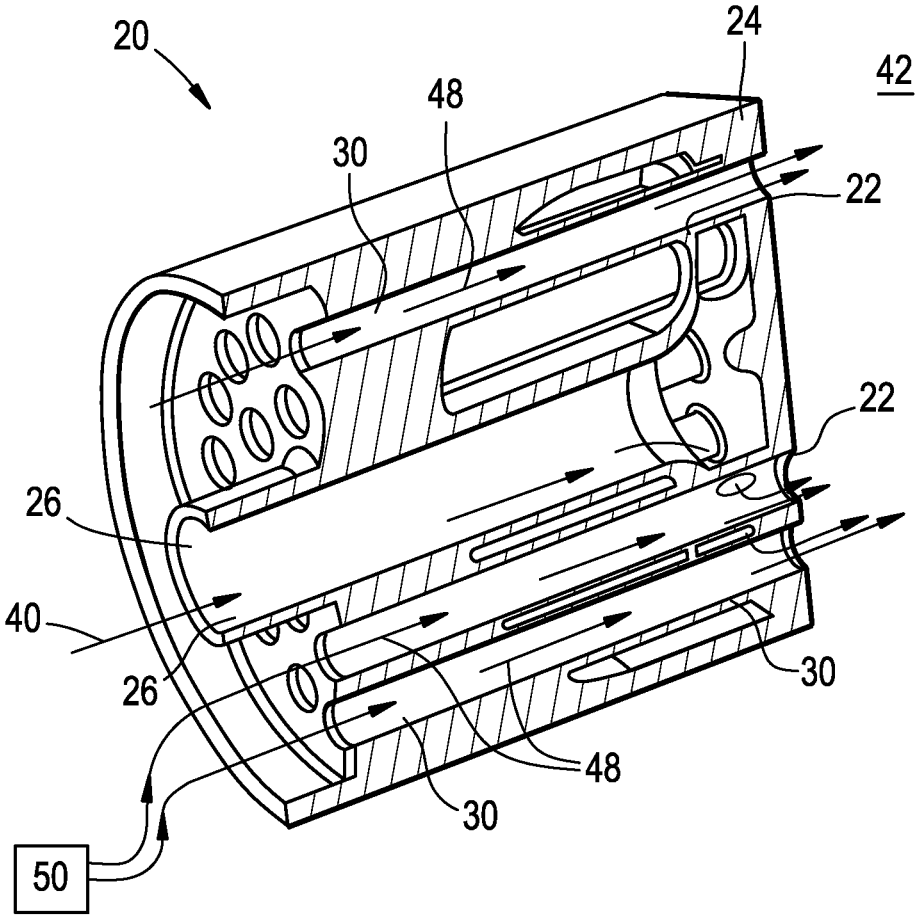
FIG. 5 is another schematic cross-sectional view of the tip of the secondary fuel nozzle of FIG. 4.

FIG. 5 illustrates operation of the secondary nozzle 14 during transfer operation. During transfer mode operation, a transfer fuel flow 48 is urged through the plurality of transfer passages 30 and into the combustion zone 42 from a transfer fuel source 50. In some embodiments, when the transfer fuel flow 48 is urged through the plurality of transfer passages 30, the flow of pilot air 46 is suspended.

The embodiments described herein provide utilize the plurality of transfer passages 30 to convey the flow of pilot air 46 during pilot mode operation to combust the flow of pilot fuel 40 and to convey the transfer fuel flow 48 during transfer mode operation. Utilizing the plurality of transfer passages 30 for both functions allows for elimination of the pilot air passages of the prior art secondary nozzle configuration resulting in a less complex secondary nozzle 14 with fewer components.

Elimination of the pilot air passages allows for an increase in a total area of the transfer passages 30. This increased area results in a greater fuel flexibility for the secondary nozzle 14, including the use of high reactivity fuels in the pilot. Because of the increased area, a higher volume of transfer fuel flow 48 can be urged therethrough, so that lower British Thermal Unit (BTU) fuels that require a greater volumetric flow rate may be utilized while maintaining operability of secondary nozzle 14.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of operating a secondary fuel nozzle for a turbomachine combustor comprising:

delivering a flow of pilot fuel through a pilot fuel channel toward a combustion zone;

delivering a flow of air through a plurality of transfer passages arranged around the pilot fuel channel toward the combustion zone;

combusting the flow of pilot fuel and the flow of air in the combustion zone;

delivering a flow of transfer fuel through the plurality of transfer passages for combustion in the combustion zone; and suspending the flow of air through the plurality of transfer passages when the flow of transfer fuel is urged through the plurality of transfer passages.

2. The method of claim 1 wherein at least partially mixing of the flow of pilot fuel and the flow of air stabilizes a pilot flame.

3. The method of claim 1 comprising delivering the flow of pilot fuel from the pilot fuel channel through a diffuser into the combustion zone.

4. The method of claim 3 wherein the diffuser is disposed at a distal end of the fuel nozzle.

5. The method of claim 3 wherein the flow of pilot fuel flows from the diffuser through the plurality of transfer passages and into the combustion zone.

6. The method of claim 1 wherein the flow of pilot fuel comprises a high reactivity fuel.

* * * * *